United States Patent [19]

Blanchard

[11] 4,408,994

[45] Oct. 11, 1983

[54] TRANSOM MOUNTED MARINE PROPULSION DEVICE WITH FORE AND AFT CRANKSHAFT AND POWER SHAFT

[75] Inventor: Clarence E. Blanchard, Kenosha, Wis.

[73] Assignee: Outboard Marine Corporation, Waukegan, Ill.

[21] Appl. No.: 247,915

[22] Filed: Mar. 26, 1981

Related U.S. Application Data

[63] Continuation-in-part of Ser. No. 188,323, Sep. 18, 1980, Pat. No. 4,371,348.

[51] Int. Cl.[3] ..... B63H 21/26; B63H 21/28

[52] U.S. Cl. ..... 440/53; 440/75

[58] Field of Search ..... 440/75, 53, 58–63, 440/76–79, 65, 56, 6, 7

[56] References Cited

U.S. PATENT DOCUMENTS

| | | | |
|---|---|---|---|
| 1,192,377 | 7/1916 | Blakely | 440/75 |
| 1,614,819 | 1/1927 | Bauer et al. | 440/75 |
| 2,213,520 | 9/1940 | Gentry | 440/7 |
| 2,691,954 | 10/1954 | Shively | 440/75 |
| 2,946,306 | 7/1960 | Leipert | 440/75 |
| 3,070,060 | 12/1962 | Harrison | 440/53 |
| 3,826,219 | 7/1974 | Nossiter | 440/75 |

FOREIGN PATENT DOCUMENTS

| | | | |
|---|---|---|---|
| 660507 | 2/1964 | Italy | 440/65 |

*Primary Examiner*—Sherman Basinger

*Attorney, Agent, or Firm*—Michael, Best & Friedrich

[57] ABSTRACT

Disclosed herein is a marine propulsion device comprising a power head adapted to be fixedly mounted to a boat hull and including an internal combustion engine having a crankshaft which extends fore and aft and horizontally when the power head is boat mounted, a power shaft extending below the crankshaft in parallel relation thereto, a belt and pulley drive operatively connected between the crankshaft and the power shaft for rotating the power shaft in response to rotation of the crankshaft, a lower unit connected to the power head and including a rotatably mounted drive shaft extending perpendicularly to the power shaft, which lower unit further includes a propeller shaft, and shafting and gearing for connecting the drive shaft and the propeller shaft, and a reversing transmission operably connected between the power shaft and the drive shaft for selectively driving the drive shaft in neutral, forward and reverse drive.

17 Claims, 2 Drawing Figures

TRANSOM MOUNTED MARINE PROPULSION DEVICE WITH FORE AND AFT CRANKSHAFT AND POWER SHAFT

RELATED APPLICATIONS

This application is a continuation-in-part of my earlier application, Ser. No. 188,323, filed Sept. 18, 1980 and entitled: *MOUNTING FOR MARINE PROPULSION DEVICE LOCATED AFT OF BOAT TRANSOM,* and incorporated herein by reference, now U.S. Pat. No. 4,371,348.

Reference is hereby also made to my co-pending application entitled "TRANSOM MOUNTED MARINE PROPULSION DEVICE WITH LATERAL CRANKSHAFT AND POWER SHAFT," Ser. No. 247,995, filed Mar. 26, 1981, now U.S. Pat. No. 4,382,797, and to my co-pending application entitled "TRANSOM MOUNTED MARINE PROPULSION DEVICE WITH VERTICAL CRANKSHAFT AND TILTABLE LOWER UNIT AND RUDDER," Ser. No. 247,792, filed Mar. 26, 1981, now U.S. Pat. No. 4,382,796.

BACKGROUND OF THE INVENTION

The invention relates generally to marine propulsion devices and more particularly to marine propulsion devices including lower units which are swingable between a lowered running position and a raised position wherein the lower unit neither engages the boat transom nor passes forwardly over the top of the boat transom when in the fully raised position.

Attention is directed to the following U.S. Pat. Nos.:

Johnson—1,824,213, Sept. 22, 1931,
Williams—2,091,247, Aug. 24, 1937,
Leipert—2,946,306, July 26, 1960,
Leipert—2,957,441, Oct. 25, 1960,
Langley—3,589,204, June 29, 1971,
Nossiter—3,826,219, July 30, 1974,
Shimanckas—3,847,108, Nov. 12, 1974.

None of the above patents discloses a fore and aft crankshaft, together with a parallel power shaft connected for rotation in response to rotation of the crankshaft. Nor do any of these patents teach or suggest a fore and aft transmission actuator in the power shaft.

SUMMARY OF THE INVENTION

The invention provides a marine propulsion device comprising a power head adapted to be fixedly mounted to a boat hull and including an internal combustion engine having a crankshaft which extends fore and aft and horizontally when the power head is boat mounted, a power shaft extending below the crankshaft in parallel relation thereto, means operatively connected between the crankshaft and the power shaft for rotating the power shaft in response to rotation of the crankshaft, a lower unit connected to the power head and including a rotatably mounted drive shaft extending perpendicularly to the power shaft, which lower unit further includes a propeller shaft, and means including gearing for connecting the drive shaft and the propeller shaft, and a reversing transmission operably connected between the power shaft and the drive shaft for selectively driving the drive shaft in neutral, forward and reverse drive.

In one embodiment of the invention, the power shaft includes an axial bore and the reversing transmission is mounted co-axially with the power shaft and includes a clutch dog mounted for movement axially of the power shaft and for rotation with the power shaft, an actuating member located in the axial bore, and means connecting the actuating member and the dog for axially shifting the dog in response to axial movement of the actuating member.

In one embodiment of the invention, the power shaft includes a forward end, the bore is open at the forward end of the power shaft, and the actuating member extends forwardly from the power shaft forward end and includes a forward end, and further including means connected to the forward end of the actuating member for axially shifting the actuating member.

In one embodiment of the invention, the marine propulsion device further includes means affording common axial movement and relative rotation between the actuating member and the dog.

In one embodiment of the invention, the lower unit includes a lower housing section supporting the propeller, and means for supporting the lower housing section for tilting movement relative to the power head about a horizontal tilt axis and for steering movement relative to the power head about a steering axis transverse to the horizontal tilt axis.

In one embodiment in accordance with the invention, the lower unit includes an upper housing section connected to the power head for steering movement about the steering axis, and the lower housing section is pivotally connected to the upper housing section about the horizontal tilt axis.

In one embodiment in accordance with the invention, the power head includes a pair of downwardly depending legs, and the lower unit includes an upper housing section connected to the legs for vertical tilting movement about the horizontal tilt axis, and the lower housing section is pivotally connected to the upper housing section for pivotal steering movement about the steering axis.

In one embodiment in accordance with the invention, the means connecting the drive shaft and the propeller shaft includes means affording continuous drive in all angular positions of the lower unit about the horizontal axis.

Other features and advantages of the embodiments of the invention will become known by reference to the following general description, claims and appended drawings.

IN THE DRAWINGS

Figure 2:
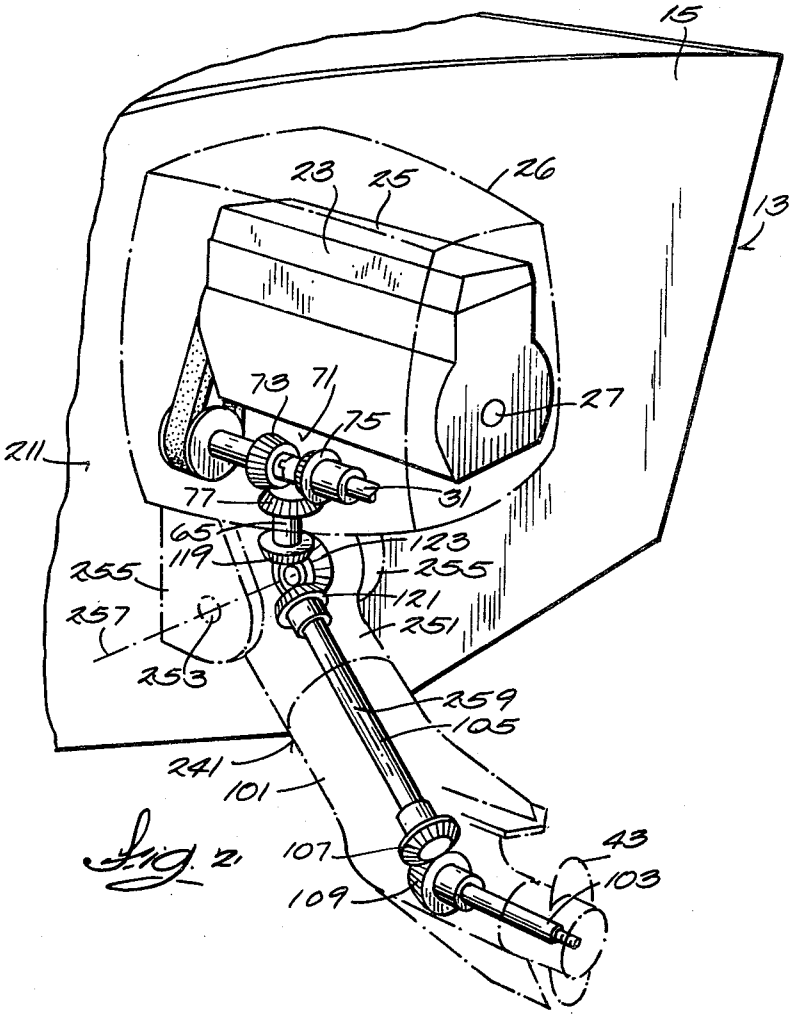
FIG. 2 is a perspective schematic view of another marine propulsion installation embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
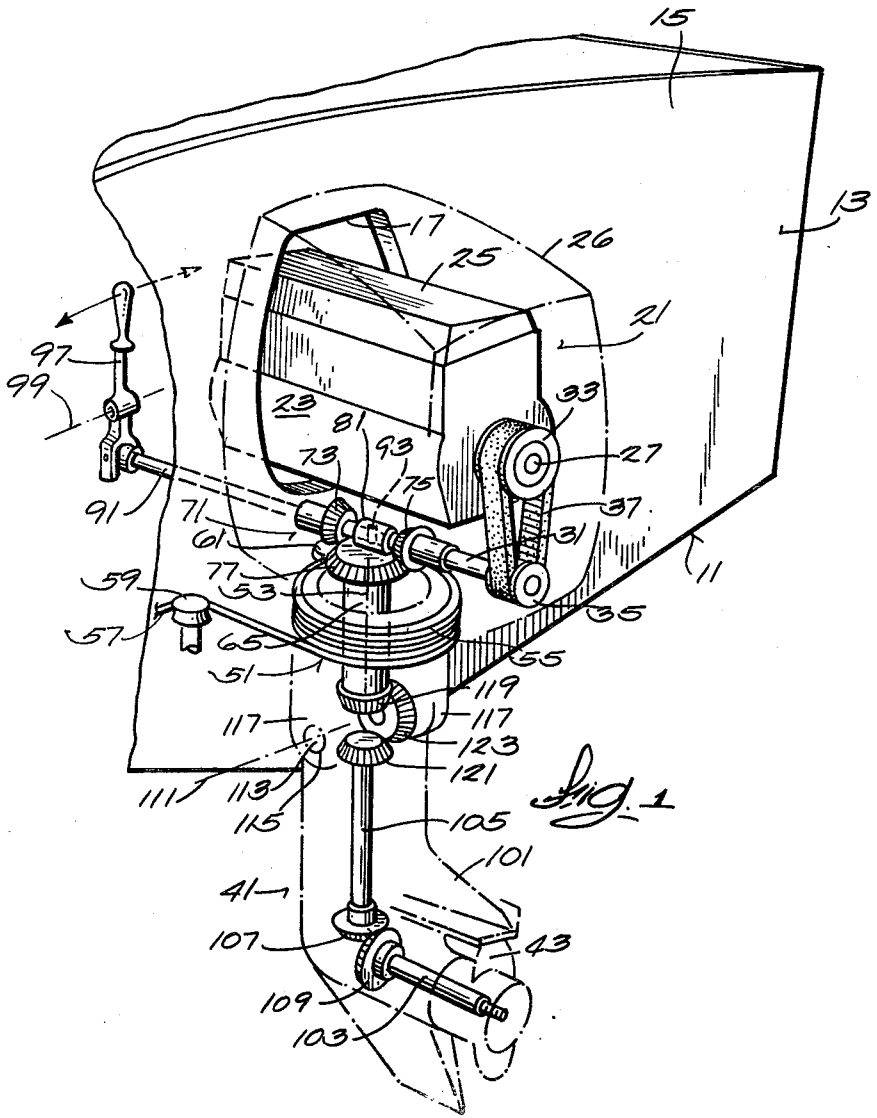
FIG. 1 is a perspective schematic view of a marine propulsion installation embodying various of the features of the invention.

Shown in FIG. 1 is a marine propulsion installation 11 including a boat hull 13 with a transom 15 having therein an opening 17. Supported from the boat hull 13 by any suitable means (not shown) is a marine propulsion device 21 including a power head 23 which extends, in part, through the transom opening 17 and includes an internal combustion engine 25. A cover 26 (shown in dotted outline) extends rearwardly from the transom 15 and encloses the rearward portion of the powerhead 23. Any suitable multi-cylinder in-line or V-block internal combustion engine can be employed, either of the two-stroke or four-stroke variety.

The engine 25 includes a crankshaft 27 which extends horizontally in the fore and aft direction when the power head 23 is boat mounted. Mounting of the power head 23 from the boat hull 13 also serves to close the transom opening 17 so as to maintain the watertight integrity of the boat hull 13.

Also included in the power head 23 is a rotatably mounted power shaft 31 which extends below and in parallel relation to the crankshaft 27.

Means are provided for rotating the power shaft 31 in response to rotation of the crankshaft 27. While various arrangements can be employed, in the illustrated construction, such means comprises a timing pulley or wheel 33 on the crankshaft 27, together with a timing pulley or wheel 35 on the power shaft 31, and an endless timing belt 37 trained around the timing pulleys 33 and 35 on the crankshaft 27 and on the power shaft 31. If desired, an endless chain or a gear train could be employed.

The marine propulsion device 23 also includes a lower unit 41 which depends from the power head 23 aft of the boat transom 15, which includes a propeller 43, and which is swingable in a vertical path and steerable in a plane which is horizontal when the lower unit is in the running position.

More particularly, the lower unit 41 includes an upper housing section 51 which is carried by any suitable bearing means for steering movement about an axis 53 which extends vertically from the axis of the power shaft 31. The upper housing section 51 can include, on the exterior surface thereof, a helical groove 55 for receiving several turns of a flexible cable 57 which extends forwardly and about two pulleys 59 and 61 for suitable connection to a remote steering control (not shown). Any other suitable arrangement can be employed for effecting steering movement of the upper housing section 51 about the vertical axis 53.

Rotatably mounted within the upper housing section 51 co-axially with the steering axis 53 is an upper drive shaft 65 which projects into the power head 23 for driving connection with the power shaft 31 through a reversing transmission 71.

While various reversing transmissions can be employed, in the illustrated construction, such means comprises a pair of spaced and facing bevel gears 73 and 75 which are mounted in the power head 23 for rotation co-axially with and relative to the power shaft 31 and which are drivingly engaged with a bevel gear 77 fixed to the top of the upper drive shaft 65.

Located between the bevel gears 73 and 75 and carried on the power shaft 31 for common rotation therewith and for axial movement relative thereto is a clutch dog 81 having lugs (not shown) which are selectively engageable with cooperating lugs (not shown) on the bevel gears 73 and 75 to effect bevel gear rotation in response to interengagement of the lugs.

The dog 81 is movable axially on the power shaft 31 between a neutral position spaced from both level gears 73 and 75, a first drive position in which the dog 81 is engaged with the bevel gear 73 to provide for rotation of the upper drive shaft 65 in one direction, and a second drive position in which the dog 81 is engaged with the other bevel gear 75 to provide for rotation of the upper drive shaft 65 in the opposite direction.

Such axial movement of the dog 81 is provided by an actuating member 91 which extends in an axial bore in the power shaft 31, which, at its rearward end, is connected to the dog 81 through a pin 93 extending radially through a radial slot (not shown) in the power shaft 31, and which, at its forward end, extends into the boat hull 13. Connected to the forward end of the actuating member 91 for relative rotation therebetween and for common movement axially of the actuating member 91 is an operating lever 97 which is pivotally mounted intermediate the ends thereof about a transverse horizontal axis 99 so as selectively to insert and withdraw the actuating member 91 relative to the power shaft 31, and thereby to axially move the clutch dog 81 in response to lever rocking movement about the axis 99, notwithstanding rotating movement of the actuating member 91.

Also included in the lower unit 41 is a lower housing section 101 which includes a propeller shaft 103 carrying the propeller 43, and a rotatably mounted lower drive shaft 105 which, at its lower end, has fixed thereto a bevel gear 107 in meshing engagement with a bevel gear 109 fixed to the propeller shaft 103.

The lower housing section 101 is connected to the bottom of the upper housing section 51 for tilting or trimming movement about a horizontal axis 111 by any suitable means. In the disclosed construction, such means comprises a pair of oppositely extending studs 113 (one shown) respectively extending from opposite sides of the lower housing section 101 into apertures or bearings 115 in a pair of laterally spaced lugs 117 extending downwardly from the bottom of the upper housing section 51.

The upper and lower drive shafts 65 and 105 are drivingly connected to each other across the horizontal axis 111 notwithstanding vertical tilting movement of the lower housing section 101 relative to the upper housing section 51 by suitable means including spaced bevel gears 119 and 121 respectively fixed to the bottom of the upper drive shaft 65 and to the top of the lower drive shaft 105, together with a bevel gear 123 which is rotatably mounted in one of the upper and lower housing sections 51 and 101 in co-axial relation to the horizontal axis 111 and which is in mesh with both bevel gears 119 and 121.

As a consequence of the foregoing construction, the lower unit 41 is tiltable from a lowered running position with the propeller 43 submerged in water to a raised position with the propeller 43 substantially out of the water, without causing engagement of the lower unit 43 with the boat transom 15 or any movement thereof forwardly over the transom 15. In addition, the lower unit 43 is steerable so as to provide control or direction of movement of the boat.

Shown in FIG. 2 is another marine propulsion installation 211 which is of generally the same construction as the installation 11 shown in FIG. 1 except as noted hereinafter. Accordingly, the same reference numerals have been applied to components in the construction shown in FIG. 2 as have been applied to the corresponding components shown in FIG. 1, and no further description of these components will be given.

The principal difference between the marine propulsion installation 211 of FIG. 2 as compared to the marine propulsion installation 11 of FIG. 1 is that the means drivingly connecting the crankshaft 27 and the power shaft 31 is located in front of the engine 25 as compared to the rear of the engine 25 and that the lower unit 241 is constructed somewhat differently.

More particularly, in the installation shown in FIG. 2, the lower unit 241 includes an upper housing section 251 which is tiltable in a vertical plane about a horizontal axis 257 formed by a pair of trunions or bearings 253 (not shown) respectively journaled in laterally spaced lugs or ears 255 projecting fixedly downwardly from the power head 23. The lower unit 241 also includes a lower housing section 101 which is tiltable with the upper housing section 251 and steerably rotatable relative thereto about a steering axis 259 extending perpendicularly from the horizontal axis 257.

Carried co-axially with the horizontal axis 257 within the upper housing section 251 is a bevel gear 123 which is in mesh with a bevel gear 119 fixed on a short, vertical stub shaft or upper drive shaft 65 which is rotatably mounted in the power head 23 and which has fixed at the top thereof a bevel gear 77 in mesh with the facing bevel gears 73 and 75 of a reversing transmission 71.

The bevel gear 123 also is in mesh with a second bevel gear 121 which is fixed to the top of a lower drive shaft 105 which extends co-axially with the steering axis 259 and rearwardly and downwardly from the bevel gear 121 through the upper and lower housing sections 251 and 101, respectively, for connection to a propeller shaft 103 which is rotatably carried in the lower housing section 101, which carries a propeller 43, and which is generally horizontal when the lower unit 241 is in the running position. Power is transmitted from the lower drive shaft 105 to the propeller shaft 103 by a bevel gear 107 which is fixed to the bottom of the lower drive shaft 105 and which is in mesh with a bevel gear 109 fixed on the propeller shaft 103.

Any suitable means (not shown) can be employed to journal the lower housing section 101 for steering movement about the steering axis 259 and for effecting such steering movement of the lower housing section 101 relative to the upper housing section 251. As in the embodiment shown in FIG. 1, the lower unit 241 of the FIG. 2 marine installation 211 can be displaced between a lowered running position with the propeller 43 submerged in water and an upper or raised position with the propeller substantially out-of-the-water without effecting engagement of the tiltable lower unit 241 with the transom 15 of the boat hull 13.

Various of the features of the invention are set forth in the following claims.

I claim:

1. A marine propulsion device comprising a power head adapted to be fixedly mounted to the transom of a boat and including an internal combustion engine having a crankshaft which extends fore and aft and horizontally when said power head is mounted to the boat transom, a power shaft extending below said crankshaft in parallel relation thereto, means operatively connected between said crankshaft and said power shaft for rotating said power shaft in response to rotation of said crankshaft, a lower unit connected to said power head and including a rotatably mounted drive shaft extending perpendicularly to said power shaft, said lower unit further including a propeller shaft, and means including gearing for connecting said drive shaft and said propeller shaft, and a reversing transmission operably connected between said power shaft and said drive shaft for selectively driving said drive shaft in neutral, forward and reverse drive.

2. A marine propulsion device in accordance with claim 1 wherein said power shaft includes an axial bore and wherein said reversing transmission is mounted co-axially with said power shaft and includes a clutch dog mounted for movement axially of said power shaft and for rotation with said power shaft, and an actuating member located in said axial bore, and means connecting said actuating member and said dog for axially shifting said dog in response to axial movement of said actuating member.

3. A marine propulsion device in accordance with claim 2 wherein said power shaft includes a forward end, wherein said bore is open at said forward end of said power shaft, and wherein said actuating member extends forwardly from said power shaft forward end and includes a forward end, and further including means connected to said forward end of said actuating member for axially shifting said actuating member.

4. A marine propulsion device in accordance with claim 3 and further including means affording common axial movement and relative rotation between said actuating member and said dog.

5. A marine propulsion device in accordance with claim 1 wherein said lower unit includes a lower housing section supporting said propeller and means for supporting said lower housing section for tilting movement relative to the power head about a horizontal tilt axis and for steering movement relative to the power head about a steering axis transverse to said horizontal tilt axis.

6. A marine propulsion device in accordance with claim 5 wherein said lower unit includes an upper housing section connected to said power head for steering movement about said steering axis, and wherein said lower housing section is pivotally connected to said upper housing section about said horizontal tilt axis.

7. A marine propulsion device in accordance with claim 5 wherein said power head includes a pair of downwardly depending legs, and wherein said lower unit includes an upper housing section connected to said legs for vertical tilting movement about said horizontal tilt axis, and wherein said lower housing section is pivotally connected to said upper housing section for pivotal steering movement about said steering axis.

8. A marine propulsion device in accordance with either of claims 5 or 6 wherein said means connecting said drive shaft and said propeller shaft includes means affording continuous drive in all angular positions of said lower unit about said horizontal tilt axis.

9. A marine propulsion installation comprising a boat with a transom having therein an opening, and a marine propulsion device including a power head extending, in part, through said transom opening and fixedly mounted to said boat hull, said power head including an internal combustion engine having a crankshaft which extends fore and aft and horizontally, a power shaft extending below said crankshaft in parallel relation thereto, means operatively connected between said crankshaft and said power shaft for rotating said power shaft in response to rotation of said crankshaft, a lower unit connected to said power head and including a rotatably mounted drive shaft extending perpendicularly to said power shaft, said lower unit further including a propeller shaft, and means including gearing for connecting said drive shaft and said propeller shaft, and a reversing transmission operably connected between said power shaft and said drive shaft for selectively driving said drive shaft in neutral, forward and reverse drive.

10. A marine propulsion installation in accordance with claim 9 wherein said power shaft also extends through said opening.

11. A marine propulsion device comprising a power head adapted to be fixedly mounted to the transom of a boat and including an internal combustion engine having a crankshaft which extends fore and aft and horizontally when said power head is mounted to the boat transom, a power shaft extending below said crankshaft in parallel relation thereto, means operatively connected between said crankshaft and said power shaft for rotating said power shaft in response to rotation of said crankshaft, and a lower unit connected to said power head and including a rotatably mounted drive shaft extending perpendicularly to said power shaft, said lower unit further including a propeller shaft, and means including gearing for connecting said drive shaft and said propeller shaft.

12. A marine propulsion device in accordance with claim 11 wherein said lower unit includes a lower housing section supporting said propeller and means for supporting said lower housing section for tilting movement relative to the power head about a horizontal tilt axis and for steering movement relative to the power head about a steering axis transverse to said horizontal tilt axis.

13. A marine propulsion device in accordance with claim 12 wherein said lower unit includes an upper housing section connected to said power head for steering movement about said steering axis, and wherein said lower housing section is pivotally connected to said upper housing section about said horizontal tilt axis.

14. A marine propulsion device in accordance with claim 12 wherein said power head includes a pair of downwardly depending legs, and wherein said lower unit includes an upper housing section connected to said legs for vertical tilting movement about said horizontal tilt axis, and wherein said lower housing section is pivotally connected to said upper housing section for pivotal steering movement about said steering axis.

15. A marine propulsion device in accordance with either of claims 12 or 13 wherein said means connecting said drive shaft and said propeller shaft includes means affording continuous drive in all angular positions of said lower unit about said horizontal tilt axis.

16. A marine propulsion installation comprising a boat with a transom having therein an opening, and a marine propulsion device including a power head extending, in part, through said transom opening and fixedly mounted to said boat hull, said power head including an internal combustion engine having a crankshaft which extends fore and aft and horizontally, a power shaft extending below said crankshaft in parallel relation thereto, means operatively connected between said crankshaft and said power shaft for rotating said power shaft in response to rotation of said crankshaft, and a lower unit connected to said power head and including a rotatably mounted drive extending perpendicularly to said power shaft, said lower unit further including a propeller shaft, and means including gearing for connecting said drive shaft and said propeller shaft.

17. A marine propulsion installation in accordance with claim 16 wherein said power shaft also extends through said opening.

* * * * *

UNITED STATES PATENT AND TRADEMARK OFFICE

CERTIFICATE OF CORRECTION

PATENT NO. : 4,408,994

DATED : October 11, 1983

INVENTOR(S) : Clarence E. Blanchard

It is certified that error appears in the above-identified patent and that said Letters Patent are hereby corrected as shown below:

Column 8, line 30, after "drive", insert -- shaft --.

Signed and Sealed this

*Thirteenth* Day of *August 1985*

[SEAL]

*Attest:*

DONALD J. QUIGG

*Attesting Officer* *Acting Commissioner of Patents and Trademarks*